US009039448B2

(12) United States Patent
Mason et al.

(10) Patent No.: US 9,039,448 B2
(45) Date of Patent: May 26, 2015

(54) ELECTRONIC INTERCONNECT DEVICES HAVING CONDUCTIVE VIAS

(71) Applicant: Tyco Electronics Corporation, Berwyn, PA (US)

(72) Inventors: Jeffery Walter Mason, North Attleboro, MA (US); Wayne Stewart Alden, III, Whitman, MA (US)

(73) Assignee: Tyco Electronics Corporation, Berwyn, PA (US)

( * ) Notice: Subject to any disclaimer, the term of this patent is extended or adjusted under 35 U.S.C. 154(b) by 20 days.

(21) Appl. No.: 13/769,584

(22) Filed: Feb. 18, 2013

(65) Prior Publication Data

US 2014/0235103 A1 Aug. 21, 2014

(51) Int. Cl.

| | |
|---|---|
| ***H01R 13/648*** | (2006.01) |
| ***H01R 13/658*** | (2011.01) |
| ***H01R 12/71*** | (2011.01) |
| ***H01R 13/24*** | (2006.01) |
| ***H01R 24/38*** | (2011.01) |

(52) U.S. Cl.

CPC ..... *H01R 13/65807* (2013.01); *H01R 12/714* (2013.01); *H01R 13/2421* (2013.01); *H01R 24/38* (2013.01)

(58) Field of Classification Search

USPC ..... 439/607.08, 607.09, 66–67, 83, 537, 439/245, 248, 75, 247, 841, 701

See application file for complete search history.

(56) References Cited

U.S. PATENT DOCUMENTS

| | | | | |
|---|---|---|---|---|
| 4,029,375 | A * | 6/1977 | Gabrielian | 439/66 |
| 4,528,500 | A * | 7/1985 | Lightbody et al. | 324/537 |
| 5,174,763 | A * | 12/1992 | Wilson | 439/66 |
| 5,388,998 | A * | 2/1995 | Grange et al. | 439/66 |
| 5,587,119 | A | 12/1996 | White | |
| 5,641,315 | A * | 6/1997 | Swart et al. | 439/824 |
| 5,949,030 | A | 9/1999 | Fasano et al. | |
| 5,990,697 | A * | 11/1999 | Kazama | 324/755.05 |
| 7,316,593 | B2 * | 1/2008 | Balsells | 439/827 |
| 7,494,387 | B2 * | 2/2009 | Ohshima et al. | 439/841 |
| 7,708,607 | B2 * | 5/2010 | Kuo et al. | 439/824 |
| 7,785,113 | B2 | 8/2010 | Mizoguchi | |
| 8,215,965 | B2 | 7/2012 | Mizoguchi | |
| 8,267,700 | B2 | 9/2012 | Mizoguchi | |
| 8,610,265 | B2 | 12/2013 | Rathburn | |
| 8,613,622 | B2 * | 12/2013 | Garcia et al. | 439/66 |
| 8,641,428 | B2 * | 2/2014 | Light et al. | 439/66 |
| 8,829,671 | B2 | 9/2014 | Rathburn | |
| 2007/0007984 | A1 * | 1/2007 | Kojima et al. | 324/765 |
| 2010/0001378 | A1 | 1/2010 | DeNatale et al. | |
| 2012/0168948 | A1 | 7/2012 | Rathburn | |
| 2012/0244728 | A1 * | 9/2012 | Rathburn | 439/83 |

* cited by examiner

*Primary Examiner* — Jean F Duverne

(57) ABSTRACT

An electronic interconnect device includes a substrate having a first surface and a second surface. The substrate has a plurality of openings extending between the first and second surfaces. Each opening has a conductive outer via, an insulative barrier and a conductive inner via. The outer via, insulative barrier and inner via are concentric within the opening such that the insulating barrier is disposed between the conductive inner via and the conductive outer via. The conductive inner via is configured to receive a conductor to be inserted therein.

20 Claims, 10 Drawing Sheets

ELECTRONIC INTERCONNECT DEVICES HAVING CONDUCTIVE VIAS

BACKGROUND OF THE INVENTION

The subject matter herein relates generally to electronic interconnect devices having conductive vias.

Electronic interconnect devices are used to interconnect two electronic components, such as integrated circuit (IC) components, printed circuit boards, electrical connectors, and the like. The electronic interconnect devices typically include an array of conductors held by a substrate. The conductors pass from one side of the substrate to the other side of the substrate to interconnect the two electronic components.

Known electronic interconnect devices are not without disadvantages. For example, there is a desire to provide shielding for high speed signal contacts. Typically the electronic interconnect devices provide ground conductors in an array interspersed between corresponding signal conductors to provide shielding for such signal conductors. Providing such ground conductors uses valuable real estate in the electronic interconnect devices. For example, some electronic interconnect devices may include 30%-50%, or more, of the conductors as ground conductors.

A need remains for an electronic interconnect device that provides high density and shielding for the signal conductors of the electronic interconnect device.

BRIEF SUMMARY OF THE INVENTION

In one embodiment, an electronic interconnect device is provided including a substrate having a first surface and a second surface. The substrate has a plurality of openings extending between the first and second surfaces. Each opening has a conductive outer via, an insulative barrier and a conductive inner via. The outer via, insulative barrier and inner via are concentric within the opening such that the insulating barrier is disposed between the conductive inner via and the conductive outer via. The conductive inner via is configured to receive a conductor to be inserted therein.

Optionally, the outer vias are electrically commoned and grounded. Optionally, the electronic interconnect device may have a ground shield on the substrate with the outer vias being electrically common with the ground shield. The substrate may be plated with a ground plating on the first surface and in the openings. The ground plating may define the ground shield on the first surface and the outer vias in the openings. Each of the outer vias may be electrically commoned by the ground shield. The insulative barriers may be coated on the corresponding outer vias. The inner vias may be plated on the corresponding insulative barriers.

Optionally, the outer vias may be electrically connected to a ground layer on the first surface. The insulative barriers may be integral with an insulative layer deposited on the ground layer. The insulative barriers may be integral with an insulative layer deposited on the second surface. The inner vias may be electrically connected to solder pads deposited on the insulative layer and solder balls may be applied to corresponding signal pads. The substrate may include at least some openings therethrough with conductive ground vias electrically connected to the outer vias, where each ground via is devoid of an insulative barrier and a conductive inner via.

In another embodiment, an electronic interconnect device is provided having a substrate having a first surface and a second surface. The substrate has a plurality of openings extending between the first and second surfaces. Each opening has a conductive outer via, an insulative barrier and a conductive inner via, wherein the outer via, insulative barrier and inner via are concentric within the opening such that the insulating barrier is disposed between the conductive inner via and the conductive outer via. Conductors are received in corresponding inner vias. The conductors are electrically connected to the inner vias. The conductors have a first end extending out of the openings configured to be electrically connected to a first electronic component.

DETAILED DESCRIPTION OF SPECIFIC EMBODIMENTS OF THE INVENTION

Figure 1:
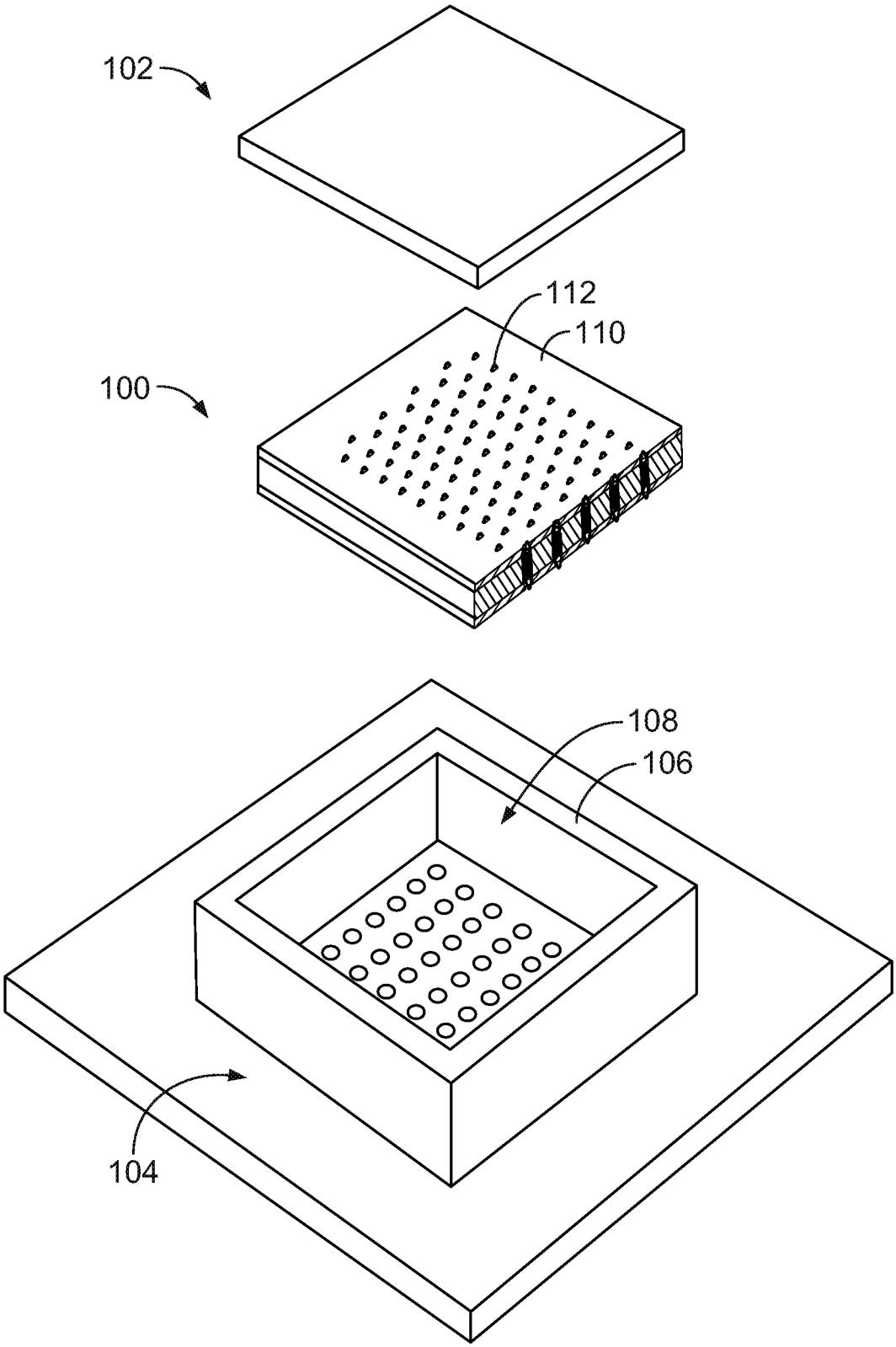
FIG. 1 is an exploded view of an electronic interconnect device used to interconnect a first electronic component with a second electronic component.

FIG. 1 is an exploded view of an electronic interconnect device 100 used to connect a first electronic component 102 with a second electronic component 104. In an exemplary embodiment, the electronic interconnect device 100 may be a socket connector configured to interconnect an integrated circuit (IC) component, a chip, a processor or other type of electronic component with a circuit board or other type of electronic component. The electronic interconnect device 100 may be an interposer or interconnect that is positioned between the first and second electronic components 102, 104 to electrically connect circuits of such components. The electronic interconnect device 100 may be a mezzanine connector interposed between two electronic components, such as two circuit boards. The electronic interconnect device 100 may be a backplane or daughtercard configured to be connected to a corresponding electrical connector. The electronic interconnect device 100 may be a micro-coax connector configured to be connected to a plurality of coaxial connectors and/or cables. Other types of electronic interconnect devices may be used in alternative embodiments.

In an exemplary embodiment, the electronic interconnect device 100 is mated to the first electronic component 102 at a separable mating interface. The electronic interconnect device 100 may be repeatedly mated and unmated with the first electronic component 102 or similar electronic components. In an exemplary embodiment, the electronic interconnect device 100 may define a test socket for testing an integrated circuit (IC) component or similar type of component. The IC components may be repeatedly tested and removed from the electronic interconnect device 100.

The electronic interconnect device 100 may be permanently or temporarily coupled to the second electronic component 104 according to various embodiments. For example, solder balls may be provided along the mating interface between the electronic interconnect device 100 and the second electronic component 104 to couple the electronic interconnect device 100 to the second electronic component 104. Alternatively, the electronic interconnect device 100 may be mated to the second electronic component 104 at a separable interface.

In the illustrated embodiment of FIG. 1, the electronic interconnect device 100 constitutes a socket connector. Other types of devices (e.g., mezzanine connector, backplane, and the like) may include other components and arrangements of the electronic interconnect device 100 for interconnecting the electronic components 102, 104. In the illustrated embodiment, a socket housing 106 is used to hold the electronic interconnect device 100. The socket housing 106 includes a socket chamber 108 that holds the electronic interconnect device 100. Other types of socket housings 106 may be used in alternative embodiments, including a socket housing 106 defined by two or more L-shaped frame pieces that are configured to be coupled to the second electronic component 104 to locate and secure the electronic interconnect device 100 and the first electronic component 102 in place. Other embodiments may not use a socket housing.

The electronic interconnect device 100 includes a substrate 110 for mechanically holding a plurality of conductors 112. In an exemplary embodiment, the substrate 110 is not a semiconductor wafer but is a circuit board level substrate. In an exemplary embodiment, the substrate 110 is configured to provide shielding for the conductors 112 so that some or each of the conductors 112 may be individually, circumferentially shielded. The conductors 112 are configured to be mated to corresponding conductors, such as pads, of the electronic components 102, 104 to electrically connect the electronic components 102, 104. The electronic interconnect device 100 may hold any number of conductors 112. The pattern or arrangement of the conductors 112 may correspond with the corresponding contacts or pads on the first and second electronic components 102, 104 to ensure that the conductors are mated to corresponding circuits of the first and second electronic components 102, 104.

In an exemplary embodiment, the conductors 112 are designed to have a tight pitch between adjacent conductors 112. The conductors 112 may be signal conductors configured to convey data signals or ground conductors configured to be electrically grounded. In an exemplary embodiment, a vast majority of the conductors 112 are signal conductors as the conductors 112 are shielded by the substrate 110. The signal conductors do not need to be flanked by ground conductors and thus more of the conductors 112 may be used as signal conductors as compared to traditional open pin field socket connectors. The substrate 110 provides electrical shielding for at least some or each of the conductors 112 individually such that there is no need for using a subset (e.g. 30-50%) of the conductors 112 as ground conductors to provide electrical shielding between signal conductors.

The conductors 112 are designed to be deflectable at first ends 114 and/or second ends 116 (both shown in FIGS. 2-3) for mating with the first electronic component 102 and/or the second electronic component 104, respectively. The conductors 112 may be designed to have a low compression load for mating the first and/or second electronic components 102, 104 with the electronic interconnect device 100. In an exemplary embodiment, the conductors 112 are designed to be compressible vertically such that the first and/or second ends 114, 116 of the conductors 112 compress in line with the loading force of the first electronic component 102 and/or the second electronic component 104.

Figure 2:
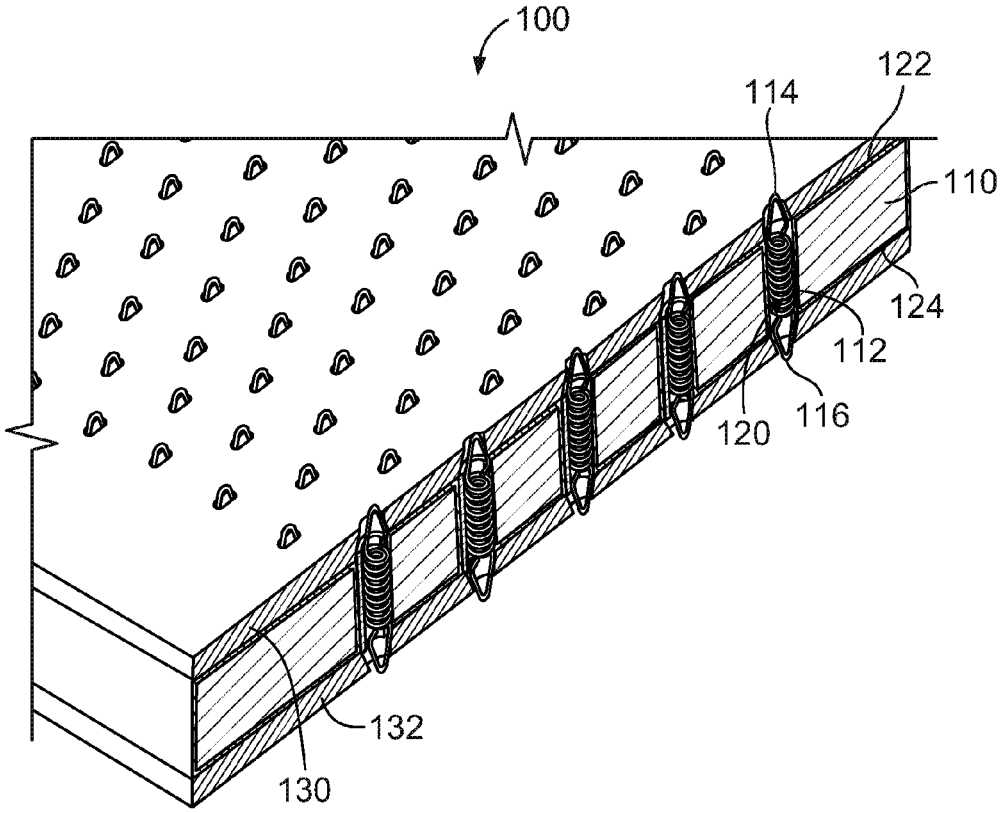
FIG. 2 is a partial sectional view of the electronic interconnect device in accordance with an exemplary embodiment.
Figure 3:
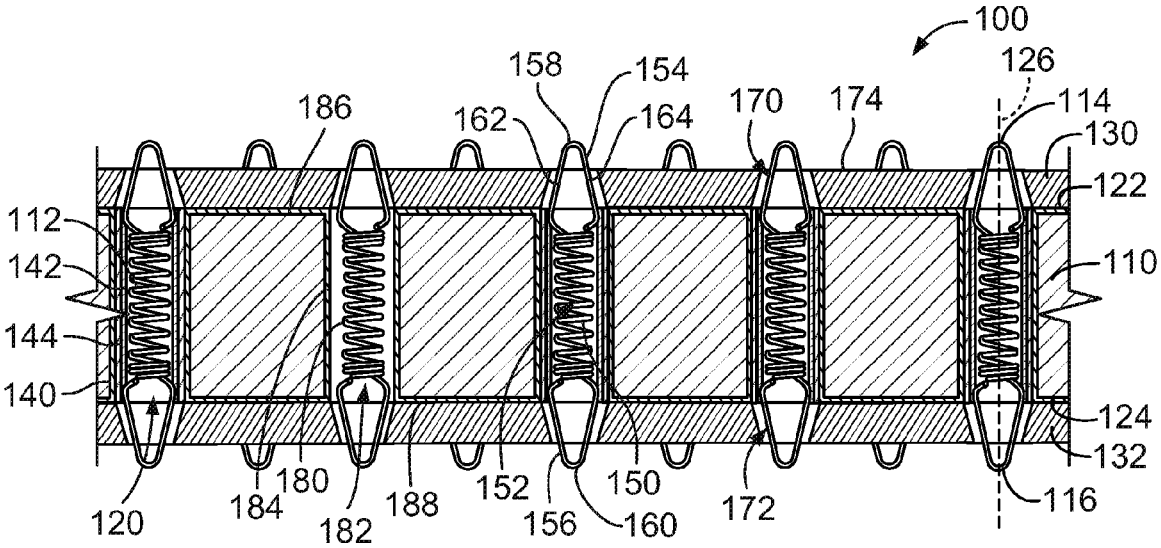
FIG. 3 is a cross sectional view of the electronic interconnect device shown in FIG. 2.

FIG. 2 is a partial sectional view of the electronic interconnect device 100 in accordance with an exemplary embodiment. FIG. 3 is a cross sectional view of the electronic interconnect device 100 in accordance with an exemplary embodiment. The substrate 110 generally holds the conductors 112 such that the conductors 112 are configured to mate with the first and second electronic components 102, 104 (both shown in FIG. 1). The array of conductors 112 are arranged in rows and columns; however other patterns of the conductors 112 are possible in alternative embodiments.

The substrate 110 includes a plurality of openings 120. The plurality of openings 120 extending between a first surface 122 and a second surface 124 of the substrate 110. The openings 120 extend along opening axes 126. In an exemplary embodiment, the electronic interconnect device 100 may be oriented such that the opening axes 126 extend generally vertically and the first and second surfaces 122, 124 extend generally horizontally. Other orientations are possible in alternative embodiments.

Covers 130, 132 are coupled to the first and second surfaces 122, 124, respectively and are used to hold the conductors 112 in the openings 120. In an alternative embodiment, the electronic interconnect device 100 may be used without the cover 130 and/or the cover 132. Covers 130, 132 may be made of plastic material, such as a polyimide type of material.

In an exemplary embodiment, the substrate 110 may be manufactured from a typical circuit board material, such as FR4 glass epoxy material; however other types of circuit board materials may be used in alternative embodiments. The substrate 110 may have one or more internally conductive layers, such as ground layers therein and/or one or more conductive layers on the first surface 122 and/or second surface.

Turning to FIG. 3, in an exemplary embodiment, the openings 120 are plated with conductive material to define conductive vias through a substrate 110. In an exemplary embodiment, the openings 120 have a conductive outer via 140, a conductive inner via 142 and an insulative barrier 144 formed or deposited between the inner and outer vias 142, 140. The insulative barrier 144 electrically isolates the inner via 142 from the corresponding outer via 140.

The conductive outer via 140, inner insulative barrier 144 and the conductive inner via 142 are concentric within the opening 120, with the insulative barrier 144 radially surrounding the inner via 142 and with the outer via 140 radially surrounding the insulative barrier 144. Such an arrangement provides a plated through-hole within a plated through-hole. The inner plated through-hole (e.g., the inner via 142) is located within the outer plated through-hole (e.g., the outer via 144). The insulative barrier 144 isolates the inner and outer vias 142, 140. For example, the inner via 142 is physically separated from the outer via 140 by the insulative barrier 144. The outer via 140 is electrically grounded to provide electrical shielding for the conductive inner via 142. The thickness and the material of the insulative barrier 144 may be selected to control the impedance or other electrical characteristics of the inner and outer vias 142, 140. The thickness of the insulative barriers 144 is defined between the outer vias 140 and the inner vias 142. The type of material of the insulative barriers 144 may be selected to control electrical characteristics of the electrical interconnect device 100.

The inner via 142 defines a single path through the substrate 110. The conductors 112 directly engage and are electrically connected to the conductive inner vias 142. Signal paths are defined through the conductors 112 and inner vias 142. Electrical paths are defined between the first and second electronic components 102, 104 through the conductors 112 and the inner vias 142.

The outer vias 140 provide electrical shielding along the entire length of the inner vias 142. The inner vias 142 have 360° shielding provided by the outer vias 140. Each adjacent conductor 112 is electrically shielded from one another by the conductive outer vias 140 extending through the substrate 110 and surrounding the conductors 112 and corresponding inner vias 142 extending through the substrate 110.

In an exemplary embodiment, few, if any, of the conductors 112 need to be ground conductors as the electrical shielding for the conductors 112 is provided using the outer vias 140. Rather, substantially all, if not all in some embodiments, of the conductors 112 may be signal conductors 112. Optionally, at least some of the conductors 112 may define drains for the grounds between the first and second electronic components 102, 104. The conductors 112 used as drains electrically connect the ground of the first electronic component 102 with the ground of the second electronic component 104. The conductive outer vias 140 associated with such ground or drain conductors may be electrically connected to any ground layers or shields of the substrate 110 to electrically common the ground of the substrate to the ground of the first and second electronic components 102, 104.

The conductors 112 include an elastic body 150 extending between the first and second ends 114, 116. "Elastic" indicates the tendency of the body to return to its original size after being deformed. In the illustrated embodiment, the elastic body 150 includes a spring 152, an arrowhead spring 154 at the first end 114 and an arrowhead spring 156 at the second end 116. The arrowhead springs 154, 156 may be integral with the spring 152, such as each being made from a wound spring steel formed at the ends into the arrowhead shape. The arrowhead springs 154, 156 have tips 158, 160, respectively. The tips 158, 160 define mating interfaces for the first and second electronic components 102, 104. The arrowhead springs 154, 156 are narrow proximate to the tips 158, 160 and widen toward the spring 152. The arrowhead spring 154 has a first arm 162 and a second arm 164 extending from the tip 158. The first arm 162 is connected to the spring 152. The second arm 164 is cantilevered and free to move. Alternatively, the second arm 164 may be connected or fixed to the spring 152. Optionally, the arrowhead spring 156 may be an identical structure as the arrowhead spring 154 and include deflectable arms; however the arrowhead spring 156 may have a different shape or features in alternative embodiments.

In an exemplary embodiment, the spring 152 is deflectable in a vertical direction when the electronic interconnect device 100 is mated to the first electronic component 102 and/or the second electronic component 104. The spring 152 may be compressed in a longitudinal direction along the corresponding opening axis 126 when the electronic interconnect device 100 is mated with the first electronic component 102 and/or the second electronic component 104. Compression of the spring 152 forces the first and second ends 114, 116 to be spring biased against the first electronic component 102 and second electronic component 104, respectively. When the electronic interconnect device 100 is coupled to the first and/or second electronic component 102, 104, the conductors 112 are compressed to shorten and widen the conductor 112 within the opening 120. As the conductor 112 widens, the conductor 112 is pressed against the conductive inner via 142 to electrically connect the conductor 112 to the conductive inner via 142. Optionally, the conductor 112 may be electrically connected to the inner via 142 even prior to compression of the conductor 112; however compression may press other portions of the conductor 112 against the inner via 142 for additional points of contact with the inner via 142. In the illustrated embodiment, when the conductor 112 is compressed, such as when the first electronic component 102 is mated to the electronic interconnect device 100, the first and second arms 162, 164 may spread apart to widen the arrowhead spring 154. The first and second arms 162, 164 are deflected outward in a horizontal direction to press outward against the conductive inner via 142. The first arm 162 and/or the second arm 164 may engage the conductive inner via 142 to create an electrical connection between the conductor 112 and the conductive inner via 142.

The covers 130, 132, include openings 170, 172, respectively, aligned with the openings 120 in the substrate 110. The conductors 112 extend into the openings 170, 172. In an exemplary embodiment, the openings 170, 172 have angled walls to capture the conductors 112 and hold the conductors 112 in the substrate 110. The openings 170, 172 may be frustoconically shaped. The angle of the walls of the openings 170, 172 may be approximately equal to the angles of the first and second arms 162, 164 of the arrowhead spring. 154. Prior to the first electronic component 102 being coupled to the electronic interconnect device 100, the conductors 112 may be spring biased against the walls defining the openings 170, 172. When the first electronic component 102 is mounted to the electronic interconnect device 100, the conductors 112 may be compressed vertically downward into the opening 170 and the opening 120 until the tip 158 is generally flush with an outer surface 174 of the cover 130. The conductor 112 may be spring biased against the first electronic component 102 to ensure electrical connection between the electronic interconnect device 100 and the first electronic component 102. The second arrowhead spring 156 may operate in a similar manner when the electronic interconnect device 100 and the second electronic component 102 are mated.

Other types of conductors 112 may be used in alternative embodiments, such as conductors that do not include coil springs or arrowhead springs. The conductors 112 may include elastomeric columns, other types of springs other than coil springs, or other types of conductors. The conductors 112 may extend vertically above and below the top and bottom surfaces 122, 124 as in the illustrated embodiment, or may extend above the top surface 122 but not below the bottom surface 124, or vice versa.

In an exemplary embodiment, the electronic interconnect device 100 includes one or more ground conductors 180. Optionally, the ground conductors 180 may be manufactured identical to the conductors 112, which are used to transmit data signals between the first and second electronic components 102, 104. The ground conductors 180 are electrically grounded to the first electronic component 102, the second electronic component 104 and/or one or more ground shields or ground layers of the substrate 110. The ground conductors 180 may define drains between the first and second electronic components 102, 104 to electrically common the ground of the first electronic component 102 with the ground of the second electronic component 104 and or with a ground of the substrate 110.

The substrate 110 includes one or more ground openings 182 with ground vias 184 extending therethrough. In specific embodiments, at least one ground opening 182, or all ground openings in another embodiment, have only conductive ground vias without use of any insulative barrier or conductive inner vias. The ground vias 184 are electrically connected to one or more ground shields or ground layers of the substrate 110. For example, a ground shield 186 may extend along the first surface 122 of the substrate 110. The ground shield 186 may be a plating layer on the first surface 122. The ground shield 186 may electrically connect each of the ground vias 184 and/or each of the conductive outer vias 140. The ground shield 186 may be deposited with the ground vias 184 and the conductive outer vias 140 during a common plating process.

Figure 4A:
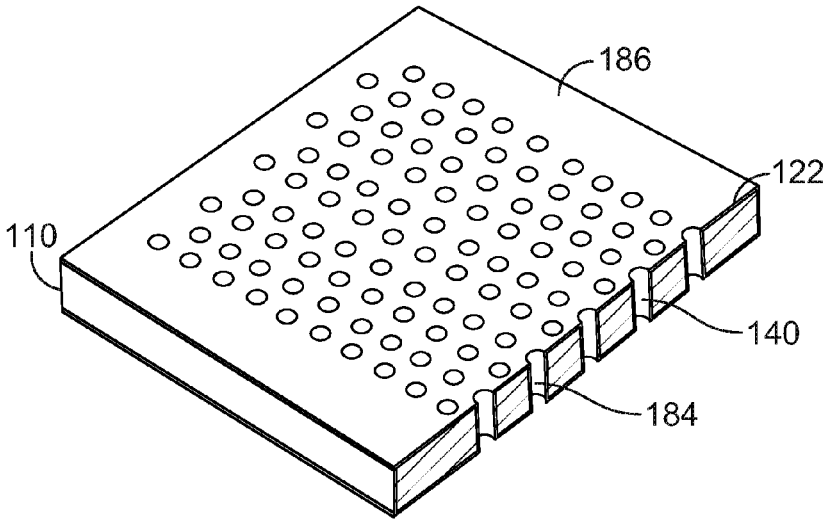
FIGS. 4A-4D illustrate a substrate of the electronic interconnect device at different stages of manufacture.

FIGS. 4A-4D illustrate the substrate 110 at different stages of manufacture. FIG. 4A illustrates the substrate 110 after a first plating process to form the ground shield 186 on the first surfaces 122 of the substrate 110, the ground vias 184 in the corresponding openings, and the conductive outer vias 140 in the corresponding openings. The first plating process may be performed in more than one step. For example, the vias 140, 184 may be plated prior to the ground shield 186 or vice versa.

Figure 4B:
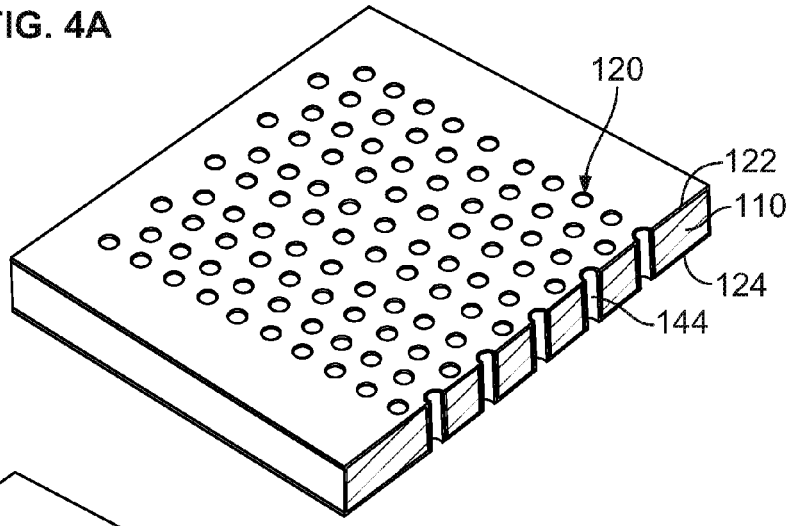

FIG. 4B illustrates the substrate 110 with the insulative barrier 144 coating the conductive outer vias 140. Optionally, the insulative barriers 144 may be contained within the openings 120. Alternatively, the insulative barriers 144 may at least partially coat the first surface 122 and/or the second surface 124. The insulative barrier 144 may be deposited by coating select portions of the substrate 110 with a dielectric material. Optionally, the insulative barrier 144 may be a polyimide material; however other types of insulative materials may be used in alternative embodiments.

Figure 4C:
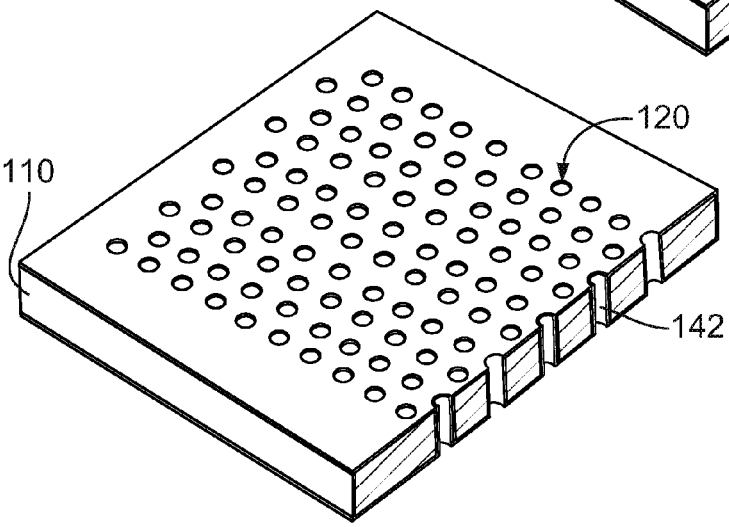

FIG. 4C illustrates the substrate 110 with the conductive inner vias 142 deposited in the openings 120. Optionally, the inner vias 142 may be plated on the insulative barriers 144. In an alternative embodiment, rather than coating the insulative barriers 144 and then plating the conductive inner vias 142 in place, the substrate 110 may be manufactured by inserting pre-made inserts into the openings 120, the pre-made inserts being barrel shaped and including an insulative layer and a plating layer rolled into the barrel shape and inserted into the opening. In other alternative embodiments, the pre-made inserts may include the insulative layer defining the insulative barriers 144 having both sides of the insulative barrier plated or coated with conductive material to define both the inner and outer vias 142, 140.

Figure 4D:
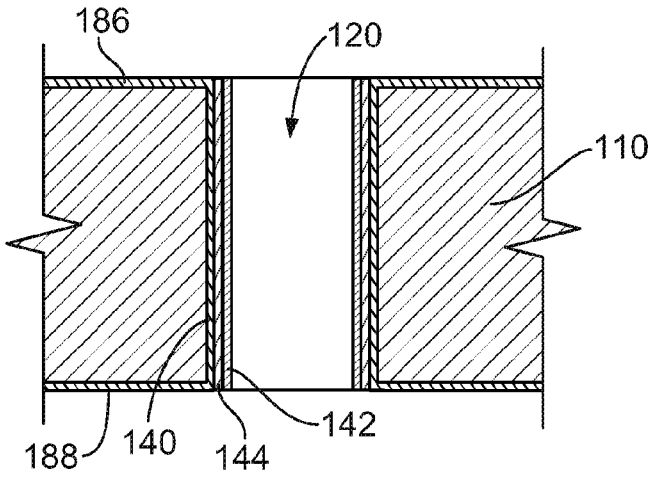

FIG. 4D illustrates a cross section of the substrate 110 showing the conductive outer vias 140, the insulative barriers 144 and the conductive inner via 142 being concentric within the opening 120. The conductive outer via 140 is connected to the ground shield 186 on the first surface 122. Optionally, the conductive outer via 140 may be connected to a ground shield 188 on the second surface 122. Optionally, insulative layers may be deposited over the ground shield 186 and/or the ground shield 188. The insulative layers may be deposited with the insulative barriers 144 in the openings 120 during a common coating process. Optionally, the inner vias 142 may have layers on the first and/or second surfaces 122, 124, such as along the insulative layers deposited on the first and/or second surfaces 122, 124.

Figure 5:
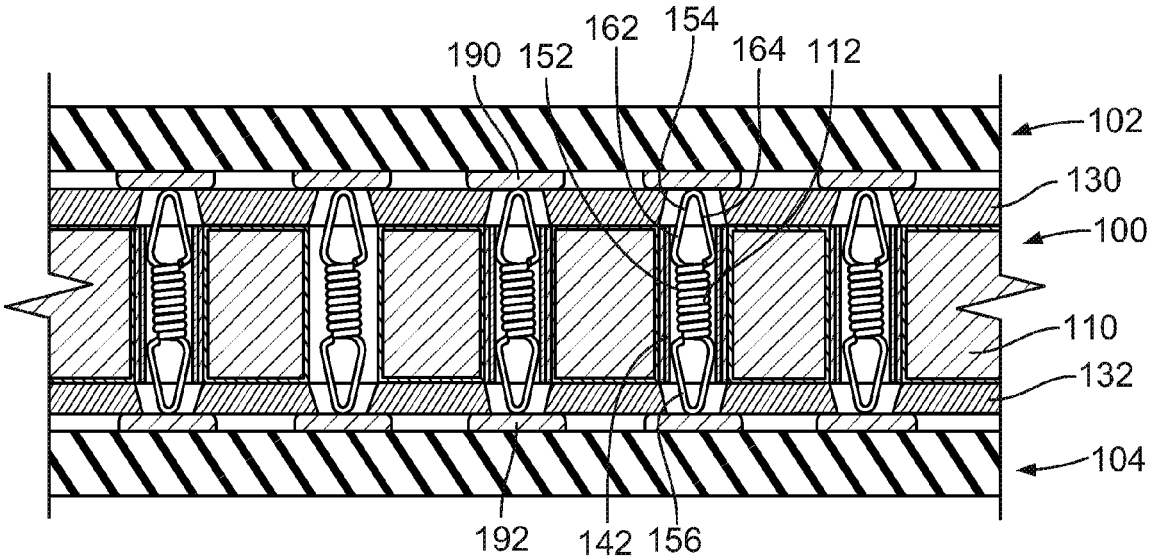
FIG. 5 illustrates the electronic interconnect device positioned between the first and second electronic components.

FIG. 5 illustrates the electronic interconnect device 100 positioned between the first and second electronic components 102, 104. The conductors 112 are compressed between the first and second electronic components 102, 104. When the electronic interconnect device 100 is mounted between the first and second electronic components 102, 104, the conductors 112 are elastically deformed, such as by compressing inwardly within the substrate 110. The spring 152 is compressed vertically to shorten the conductors 112. The arrowhead springs 154, 156 are compressed causing the first and second arms 162, 164 to be deflected horizontally outward to press outward against the conductive inner vias 142. A direct electrical connection is made at the point(s) of contact between the conductor 112 and the inner via 142.

The spring 152 presses the arrowhead springs 154, 156 outward against the first and second electronic components 102, 104 to maintain direct physical contact between the conductors 112 and corresponding mating pads 190, 192 of the first and second electronic components 102, 104, respectively. The covers 130, 132 define compression limits for the electronic interconnect device 100 when the first and second electronic components 102, 104 are pressed inward against the electronic interconnect device 100.

Figure 6:
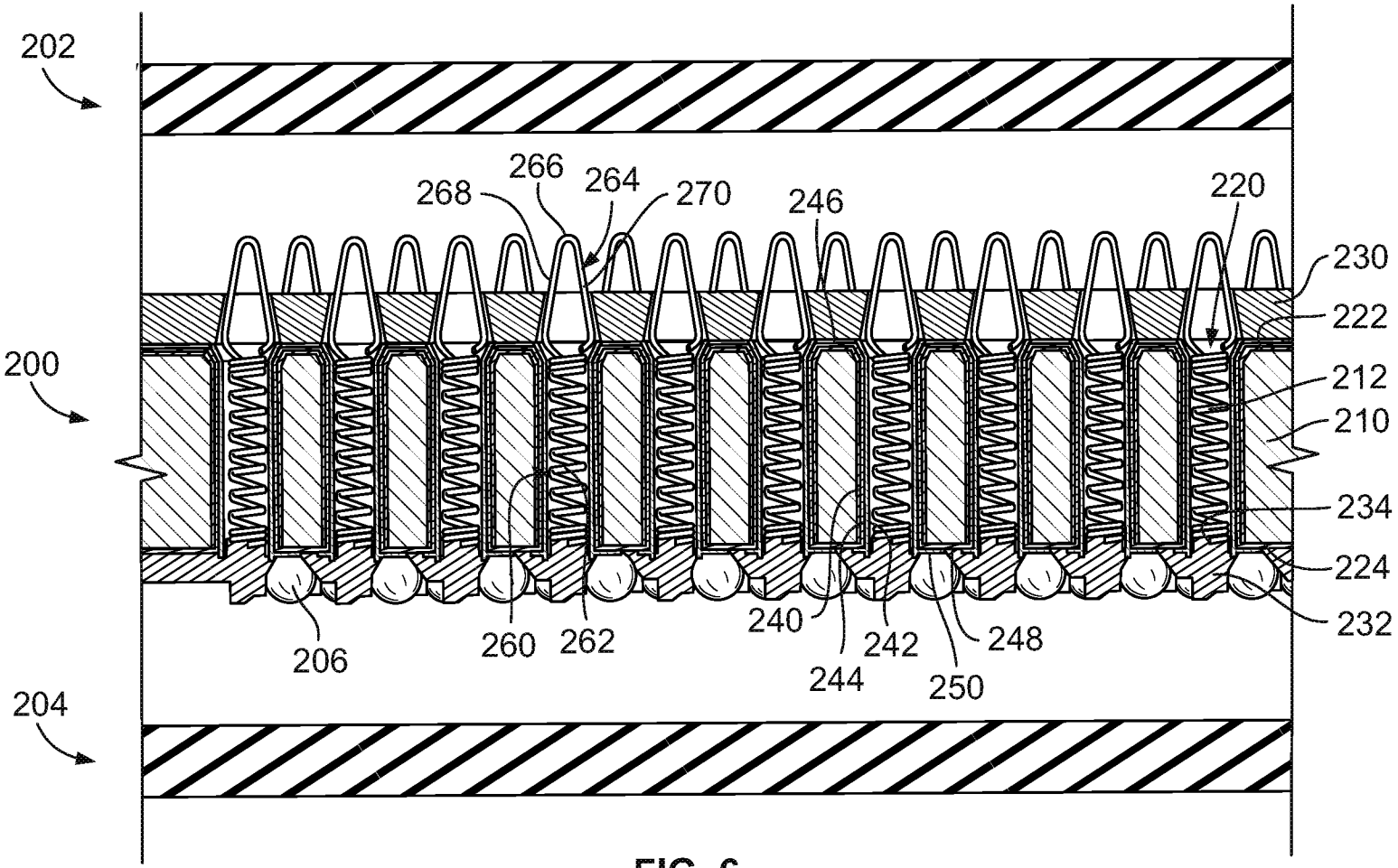
FIG. 6 is a cross sectional view of an electronic interconnect device used to interconnect first and second electronic components.
Figure 7:
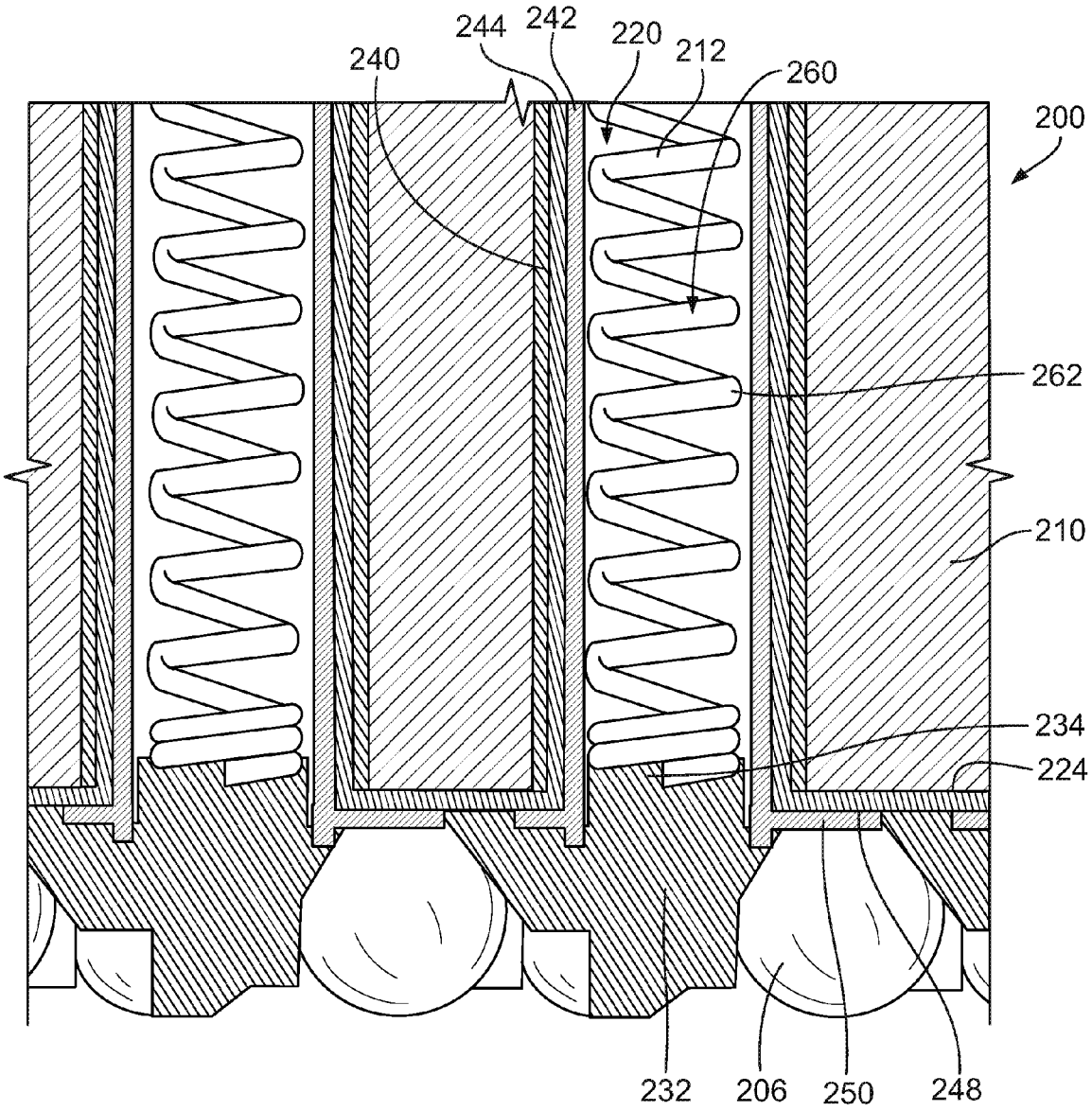
FIG. 7 is an enlarged view of a portion of the electronic interconnect device shown in FIG. 6 showing the conductors in a compressed state.

FIG. 6 is a cross sectional view of an electronic interconnect device 200 used to interconnect first and second electronic components 202, 204. FIG. 7 is an enlarged view of a portion of the electronic interconnect device 200. The electronic interconnect device 200 is similar to the electronic interconnect device 100 (shown in FIG. 1); however the electronic interconnect device 200 includes solder balls 206 at the mating interface with the second electronic component 204.

The electronic interconnect device 200 includes a substrate 210 holding a plurality of conductors 212. The substrate 210 includes a plurality of openings 220 extending between first and second surfaces 222, 224. Optionally, the openings 220 may be chamfered or angled at the tops and/or bottoms of the openings 220. The solder balls 206 are arranged at the second surface 224. The electronic interconnect device 200 includes a cover 230 along the first surface 222 and a cover 232 along the second surface 224. The cover 230 holds the conductors 212 in the openings 220. The cover 232 holds the conductors 212 in the openings 220. The cover 232 may hold the solder balls 206 in position for mounting to the second electronic component 204. In an exemplary embodiment, the cover 232 includes protrusions 234 extending into the openings 220. The protrusions 234 support the conductors 212 within the openings 220.

The substrate 210 includes conductive outer vias 240, conductive inner vias 242 and insulative barriers 244 between the outer vias 240 and inner vias 242. In an exemplary embodiment, the conductive outer vias 240 are defined by a conductive ground plating within the openings 220 and along the first surface 222.

The insulative barriers 244 are coated along the conductive outer vias 240. In an exemplary embodiment, the electronic interconnect device 200 includes insulative layers 246, 248 on the first surface 222 and the second surface 224, respectively. The insulative barriers 244 may be integral with the insulative layers 246, 248, such as by forming the insulative barriers 244 and insulative layers 246, 248 during a common coating process.

The conductive inner vias 242 are deposited on the insulative barriers 244 within the openings 220. In an exemplary embodiment, the electronic interconnect device 200 includes signal pads 250 deposited on the insulative layer 248 along the second surface 224. The signal pads 250 are electrically connected to corresponding conductive inner vias 242. The solder balls 206 are applied to corresponding pads 250. The solder balls 206 may be soldered to the signal pads 250. Electrical paths are defined from the conductors 212 to the corresponding inner vias 242 and the electrical paths extend from the inner vias 242 along the signal pads 250 to the solder balls 206 for connection to the second electronic component 204.

The conductors 212 each include an elastic body 260. In the illustrated embodiment, the elastic body 260 includes a spring 262 received in the opening 220 and an arrowhead spring 264 at an end of the conductor 212. The arrowhead spring 264 may extend out of the openings 220 for connection to the first electronic component 202. The arrowhead spring 264 includes a tip 266 and first and second arms 268, 270. The first arm 268 is connected to the spring 262. The second arm 270 is free and is configured to be pressed against the conductive inner via 242 when the conductor 212 is compressed. The first and second arms 268, 270 are deflectable in a horizontal direction to press outward against the conductive inner via 242 when the first electronic component 202 is mounted to the electronic interconnect device 200. Optionally, as the conductor 212 is compressed vertically and the conductor 212 is pressed into the opening 220, the arrowhead spring 264 may be deflected horizontally inward by the walls of the opening 220, such as at the chamfered entrance to the opening 220. As the arrowhead spring 264 is pressed inward, the first and second arms 268, 270 are spring biased outward against the inner via 242 ensuring electrical contact between the conductor 212 and the inner via 242.

The end of the spring 262 opposite the arrowhead spring 264 is supported by the cover 232. The spring 262 rests on the protrusion 234 and is held in the opening 220 by the protrusion 234. The spring 262 may be compressed against the protrusion 234 when the first electronic component 202 is coupled to the electronic interconnect device 200. The spring 262 is deflectable in a vertical direction into the opening 220.

Figure 8:
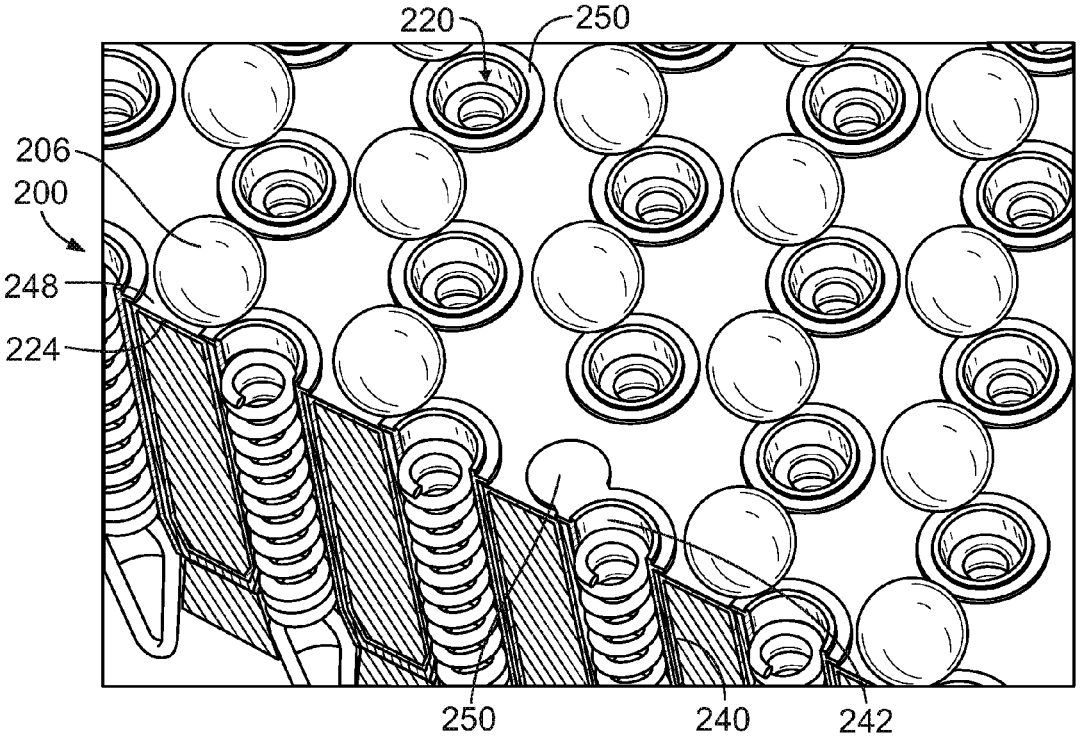
FIG. 8 illustrates a portion of the electronic interconnect device showing the bottom of the electronic interconnect device.
Figure 9:
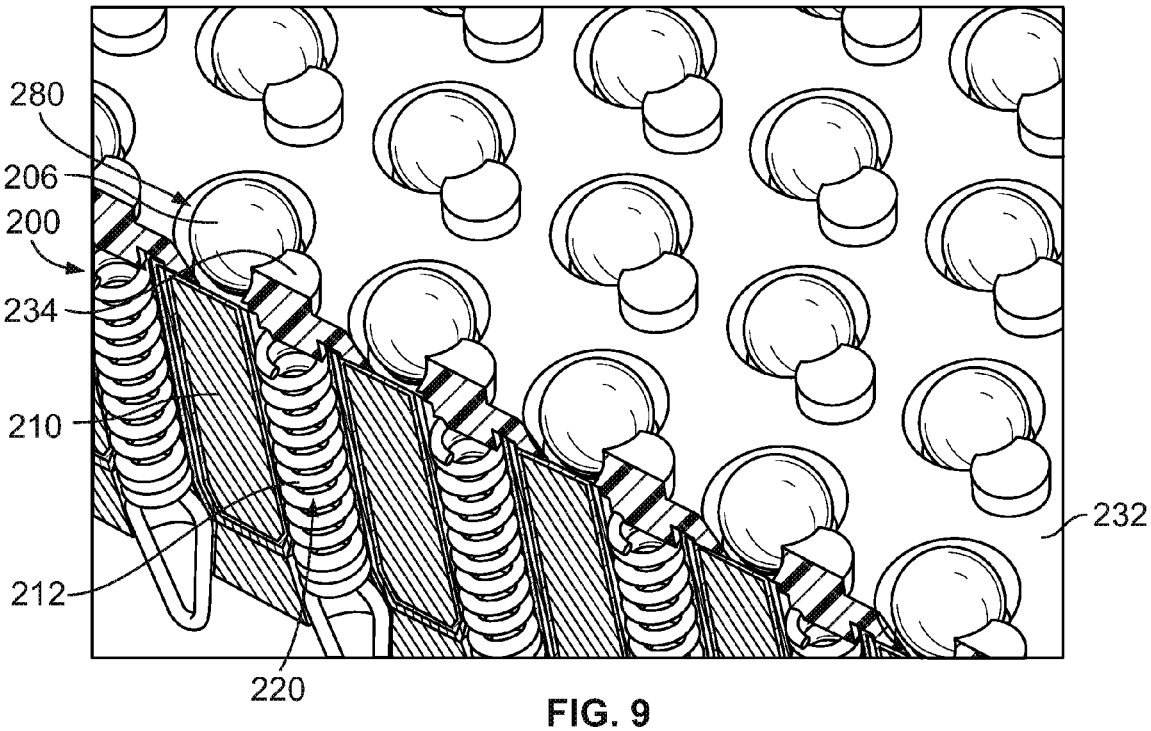
FIG. 9 is a bottom perspective, partial sectional view of the electronic interconnect device.

FIG. 8 illustrates a portion of the electronic interconnect device 200 showing the bottom of the electronic interconnect device 200 without the cover 232 (shown in FIG. 9). The insulative layer 248 is provided on the second surface 224. For example, the insulative layer 248 may be coated over the second surface 224 and into the openings 220 to cover the conductive outer vias 240. Optionally, a shield layer may be provided between the insulative layer 248 and the second surface 224, which is connected to each of the conductive outer vias 240. The signal pads 250 are deposited on the insulative layer 248 and electrically connected to corresponding conductive inner vias 242. Optionally, the signal pads 250 may be plated on the insulative layer 248. Optionally, the signal pads 250 may be plated during a common plating process with the corresponding conductive inner vias 242. The solder balls 206 are applied to the signal pads 250. In an exemplary embodiment, the solder balls 206 are applied to the signal pads 250 after the cover 232 (shown in FIG. 6) is coupled to the substrate 210.

FIG. 9 is a bottom perspective, partial sectional view of the electronic interconnect device 200 showing the cover 232 coupled to the substrate 210. The solder balls 206 are located in corresponding openings 280 in the cover 232. The protrusions 234 extend into the openings 220 to support the conductors 212.

Figure 10:
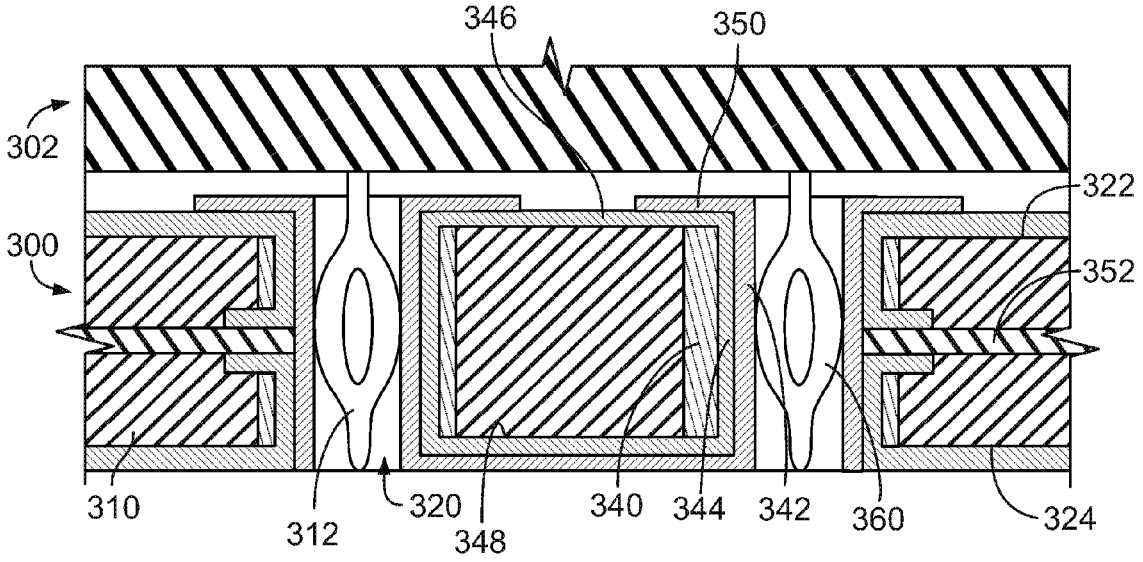
FIG. 10 is a cross sectional view of an electronic interconnect device configured to be coupled to a first electronic component, according to an exemplary embodiment.

FIG. 10 is a cross sectional view of an electronic interconnect device 300 configured to be coupled to a first electronic component 302. In an exemplary embodiment, the electronic interconnect device 300 is a circuit board and the first electronic component 302 is an electrical connector. For example, the electronic interconnect device 300 may be a backplane and the first electronic component 302 may be a backplane connector. The first electronic component 302 includes a plurality of conductors 312 extending therefrom. Optionally, the conductors 312 may be conductive compliant pins, such as eye-of-the-needle pins, extending from the first electronic component 302. The conductors 312 are configured to be plugged into the electronic interconnect device 300 for electrical connection thereto, such as by a press fit and/or soldering.

The electronic interconnect device 300 includes a substrate 310 having a plurality of openings 320 extending between first and second surfaces 322, 324 of the substrate 310. The conductors 312 extend into the openings 320 for termination to the electronic interconnect device 300. The substrate 310 includes conductive outer vias 340, conductive inner vias 342 and insulative barriers 344 between the outer vias 340 and inner vias 342. In an exemplary embodiment, the conductive outer vias 340 are defined by a ground plating within the openings 320 and along the first surface 322. Optionally, at least some of the openings 320 have only one plating layer defining a ground via and do not include an insulative barrier or an inner via. Such ground vias are configured to be connected to ground conductors of the electronic component 302.

The insulative barriers 344 are coated along the conductive outer vias 340. In an exemplary embodiment, the electronic interconnect device 300 includes an insulative layer 346 on the first surface 322. The insulative barriers 344 may be integral with the insulative layers 346, such as by forming the insulative barriers 344 and insulative layers 346 during a common coating process.

The conductive inner vias 342 are deposited on the insulative barriers 344 within the openings 320. In an exemplary embodiment, the electronic interconnect device 300 includes signal pads 350 deposited on the insulative layer 346 along the first surface 322. The signal pads 350 are electrically connected to corresponding conductive inner vias 342. The conductors 312 may engage the signal pads 350 in addition to the inner vias 342 to electrically connect the conductors 312 to the electronic interconnect device 300. Electrical paths are defined from the conductors 312 to the corresponding inner vias 342 and the electrical paths extend from the inner vias 342 to a corresponding circuit trace 352 on a circuit layer of the substrate 310. Optionally, the circuit traces 352 pass through the outer vias 340 and the insulative barriers 344, such as through gaps in the plating and coating layers defining the outer vias 340 and insulative barriers 344, respectively. Alternatively, the circuit traces 352 may be connected to the inner vias 342 on the second surface 324 of the substrate 310.

In the illustrated embodiment, the conductors 312 each include an elastic body 360 defined by the compliant pin. The compliant pin is received in the opening 320 and is compressed against the inner via 342 to make an electrical connection therewith. Other types of conductors 312 and connectors 302 may be used in alternative embodiments, such as cables and cable connectors. Optionally, the conductors 312 may be connected to another electronic component, such as another circuit board or another electrical connector, at the bottom side of the substrate 310 using the inner vias 342.

Figure 11:
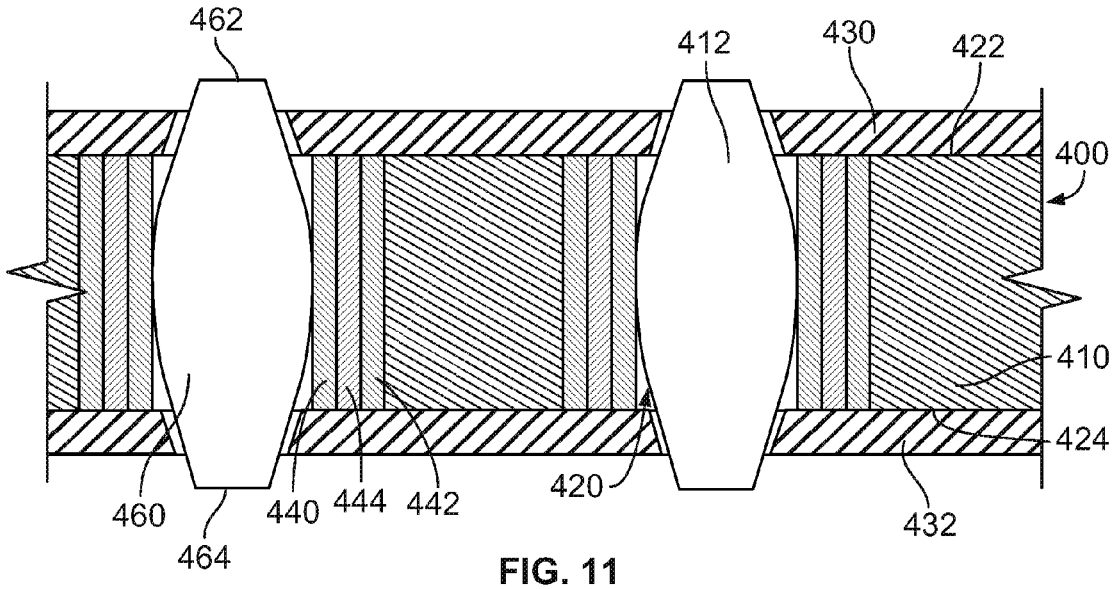
FIG. 11 is a cross sectional view of an electronic interconnect device to be used to interconnect first and second electronic components, according to an exemplary embodiment.
Figure 12:
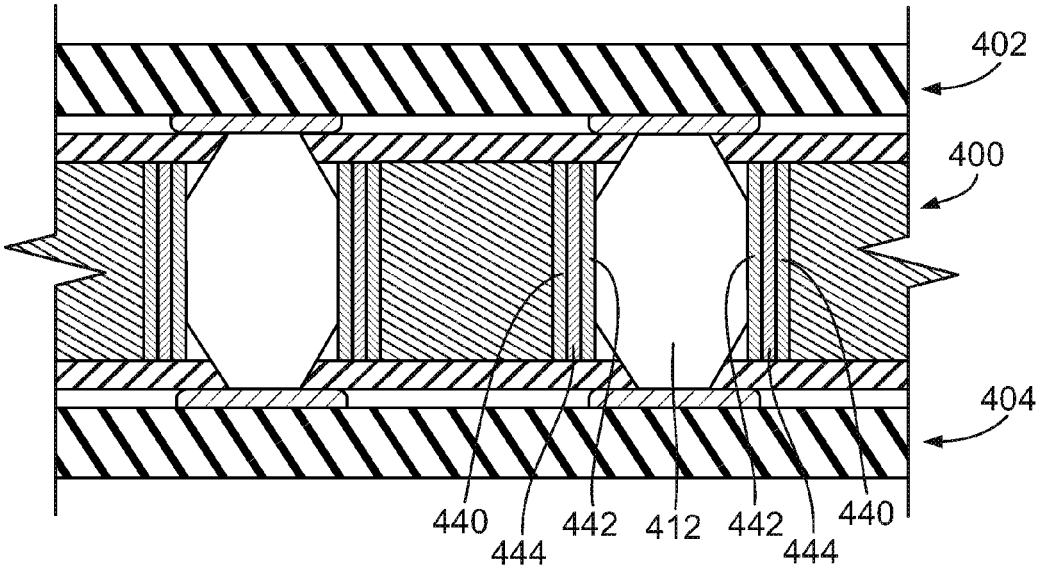
FIG. 12 is a cross sectional view of a portion of the electronic interconnect device shown in FIG. 11 showing conductors in a compressed state.

FIG. 11 is a cross sectional view of an electronic interconnect device 400 to be used to interconnect first and second electronic components 402, 404 (shown in FIG. 12). The electronic interconnect device 400 is similar to the electronic interconnect device 100 (shown in FIG. 1); however the electronic interconnect device 400 uses a different type of conductor.

The electronic interconnect device 400 includes a substrate 410 holding a plurality of conductors 412. The substrate 410 includes a plurality of openings 420 extending between first and second surfaces 422, 424. The electronic interconnect device 400 includes a cover 430 along the first surface 422 and a cover 432 along the second surface 424. The covers 430, 432 are configured to hold the conductors 412 in the openings 420. The covers 430, 432 define compression limits for the conductors 412 when mating with the first and second electronic components 402, 404.

The substrate 410 includes conductive outer vias 440, conductive inner vias 442 and insulative barriers 444 between the outer vias 440 and inner vias 442. In an exemplary embodiment, the conductive outer vias 440 are coupled to a ground plating within the openings 420 and along the first surface 422. The insulative barriers 444 are coated along the interior of conductive outer vias 440. The conductive inner vias 442 are deposited on the insulative barriers 444 within the openings 420. Optionally, solder balls may be provided at the bottom side of the substrate 410 in a similar manner as shown in FIG. 6.

The conductors 412 each include an elastic body 460. In the illustrated embodiment, the elastic body 460 includes a conductive elastomeric column. For example, made of a mixture of an elastic material and conductive particles, such as silver or other metal particles or conductive nanoparticles, the elastomeric column is internally conductive. In the illustrated embodiment, first and second ends 462, 464 of the conductors 412 may extend out of the openings 420 for connection to the first and second electronic components 402, 404. The first and second ends 462, 464 are compressible and may be deflected vertically into the openings 420. The vertical deflection may cause outward deflection in a horizontal direction to press outward against the conductive inner via 442.

FIG. 12 is a cross sectional view of the electronic interconnect device 400 showing the conductors 412 in a compressed state when mated between the first and second electronic components 402, 404. The conductors 412 are deflected outward against the inner vias 442 to create points of contact with the inner vias 442 to electrically connect the conductors 412 to the inner vias 442. The outer vias 440 provide electrical shielding for the inner vias 442 and the conductors 412. Optionally, at least some ground vias may be provided that do not include an insulative barrier or an inner via. Such ground vias are configured to be connected to ground conductors of the electronic interconnect device 400.

Figure 13:
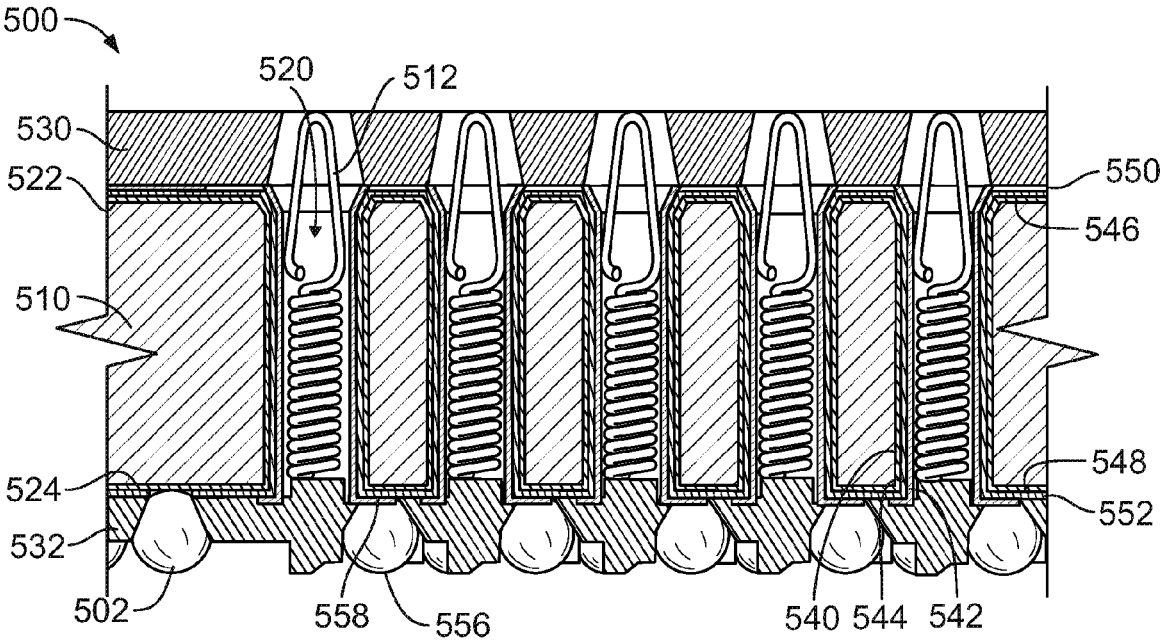
FIG. 13 is a cross sectional view of an electronic interconnect device to be used to interconnect first and second electronic components, according to an exemplary embodiment showing conductors in a compressed state.

FIG. 13 a cross sectional view of an electronic interconnect device 500 used to interconnect first and second electronic components (not shown) showing conductors 512 in a compressed state. The electronic interconnect device 500 is similar to the electronic interconnect device 200 (shown in FIG. 6); however the electronic interconnect device 500 uses a solder ball 502 to directly attach a ground shield or ground layer of the electronic interconnect device to the second electronic component.

The electronic interconnect device 500 includes a substrate 510 holding a plurality of conductors 512. The substrate 510 includes a plurality of openings 520 extending between first and second surfaces 522, 524. The electronic interconnect device 500 includes a cover 530 along the first surface 522 and a cover 532 along the second surface 524.

The substrate 510 includes conductive outer vias 540, conductive inner vias 542 and insulative barriers 544 between the outer vias 540 and inner vias 542. The conductive inner vias 542 are deposited on the insulative barriers 544 within the openings 520. In an exemplary embodiment, the conductive outer vias 540 are defined by a ground plating within the openings 520. The ground plating also defines ground shields 546, 548 along the first and second surfaces 522, 524, which electrically connect each of the conductive outer vias 540. The insulative barriers 544 are deposited on the conductive outer vias 540. The insulative barriers 544 are coated with first and second insulative layers 550, 552 along the ground shields 546, 548 and first and second surfaces 522, 524. The second insulative layer 552 includes a gap 554 exposing the second ground shield 548. The solder ball 502 is electrically coupled to the second ground shield 548 at the gap 554. Solder balls 556 are provided at the bottom side of the substrate 510 and are electrically connected to solder pads 558 deposited on the second insulative layer 552. The solder pads 558 are electrically connected to corresponding inner vias 542.

In an exemplary embodiment, the conductors 512 may be either ground conductors or signal conductors. The ground conductors may be electrically connected to the corresponding outer via 540 and/or the ground shields 546 and/or 548. Optionally, the inner vias 542 and/or the solder pads 558 associated with the ground conductors may be electrically connected to the corresponding outer vias 540 and/or ground shield 548, such as by passing through the insulative barrier 544 and/or the insulative layer 552.

Figure 14:
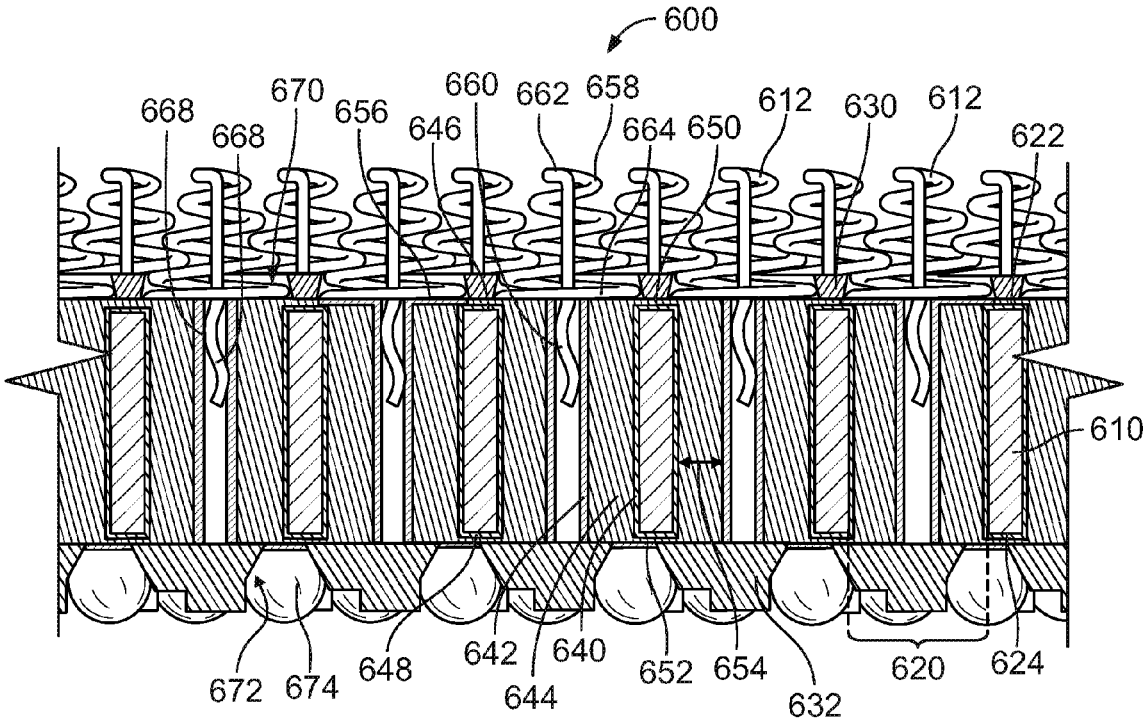
FIG. 14 is a cross sectional view of an electronic interconnect device to be used to interconnect first and second electronic components, according to an exemplary embodiment showing conductors thereof in an uncompressed state.
Figure 15:
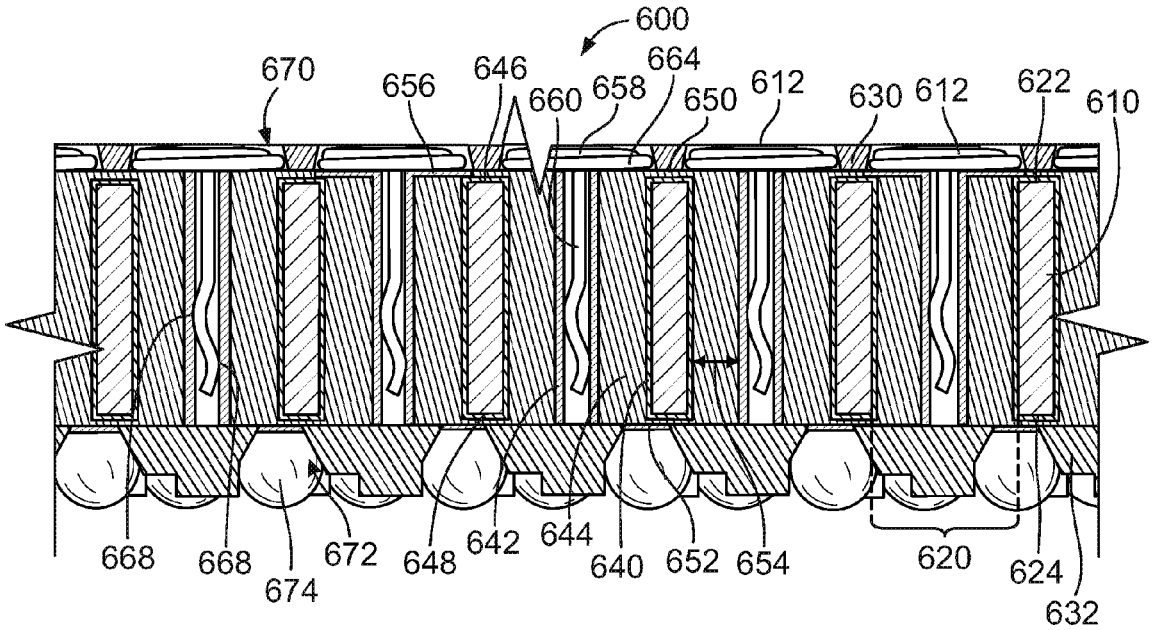
FIG. 15 is a cross sectional view of the electronic interconnect device shown in FIG. 14 showing the conductors in a compressed state.

FIG. 14 is a cross sectional view of an electronic interconnect device 600 used to interconnect first and second electronic components (not shown). FIG. 14 illustrates conductors 612 thereof in an extended or uncompressed state. FIG. 15 is a cross sectional view of the electronic interconnect device 600 showing the conductors 612 in a retracted or compressed state. The electronic interconnect device 600 is similar to the electronic interconnect device 200 (shown in FIG. 6); however the electronic interconnect device 600 uses a different type of conductor 612 than the electrical interconnect device 200.

The electronic interconnect device 600 includes a substrate 610 holding a plurality of conductors 612. The substrate 610 includes a plurality of openings 620 extending between first and second surfaces 622, 624. The electronic interconnect device 600 includes a cover 630 along the first surface 622 and a cover 632 along the second surface 624.

The openings 620 in substrate 610 include conductive outer vias 640, conductive inner vias 642 and insulative barriers 644 between the outer vias 640 and inner vias 642. The conductive inner vias 642 are deposited on the insulative barriers 644 within the openings 620. In an exemplary embodiment, the conductive outer vias 640 are defined by a ground plating within the openings 620. The ground plating also defines ground shields 646, 648 along the first and second surfaces 622, 624, which electrically connect each of the conductive outer vias 640.

The insulative barriers 644 are deposited on the conductive outer vias 640. The insulative barriers 644 are connected with first and second insulative layers 650, 652 along the ground shields 646, 648 and first and second surfaces 622, 624. Optionally, the insulative barriers 644 and insulative layers 650, 652 may be deposited, such as by coating, during a common depositing process. In an exemplary embodiment, a thickness 654 of the insulative barriers 644 defined between the outer vias 640 and the inner vias 642, may be selected to control electrical characteristics of the electrical interconnect device 600, such as to control an impedance of the signal paths through the electrical interconnect device 600. The type of material of the insulative barriers 644 may be selected to control electrical characteristics of the electrical interconnect device 600. In the illustrated embodiment, the insulative barriers 644 are thicker than the insulative barriers 144 (shown in FIG. 3).

In an exemplary embodiment, at least some of the conductors 612 may define ground conductors configured to be electrically grounded to the corresponding outer via 640 and/or the ground shield 646. A ground pad 656 may be provided on the first surface 622 to be electrically connected to the inner via 642 and the outer via 644 of the corresponding opening 620. The conductor 612 may be directly connected to the ground pad 656, or may be indirectly connected to the ground pad 656, such as by the inner via 642. The electrically grounded conductor 612 may operate as a drain to connect grounds of the first and second electronic components. The ground pad 656 may be provided in a gap or opening in the insulative layer 650.

Each conductor 612 includes an elastic body. In the illustrated embodiment, the elastic body includes a spring 658 and a pin 660 extending from the spring 658. In an exemplary embodiment, the pin 660 extends from a tip 662 of the spring 658 to a distal end which has mating interfaces 668. The pin 660 may be integral with the spring 658, such as each being made from a wound spring steel formed into a spiral, helical or other shape with the pin 660 passing through a center of the spring 658 beyond a base 664 of the spring 658. The tip 662 defines a mating interface for the conductor 612. Optionally, the spring 658 may be conical shaped. The spring 658 is deflectable in a vertical direction when the electronic interconnect device 600 is mated with the first electronic component. The spring 658 may be compressed in a longitudinal direction along the axis of the corresponding opening 620. Compression of the spring 658 forces the tip 662 to remain resiliently engaged with the first electronic component.

The spring 658 is illustrated in a compressed state in FIG. 14. As the spring 658 is being compressed, the pin 660 is pressed downward into the opening 620 as seen in FIG. 15. The pin 660 includes mating interfaces 668 that engage the inner via 642 to electrically connect the conductor 612 to the inner via 642. For example, the pin 660 may have bent portions providing a wavy configuration that allows the mating interfaces 668 to press against the inner via 642.

The covers 630 and 632 include openings 670 and 672, respectively, aligned with the openings 620 in the substrate 610. The conductors 612 extend into the openings 670. In an exemplary embodiment, the openings 670 have angled walls to capture the base 664 of the spring 658. The openings 672 hold corresponding solder balls 674.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electronic interconnect device comprising:

a substrate having a first surface and a second surface, the substrate having a plurality of openings extending between the first and second surfaces, each opening having a conductive outer via, an insulative barrier deposited on the conductive outer via, and a conductive inner via deposited on the insulative barrier, wherein the conductive outer via, insulative barrier and conductive inner via are concentric within the opening such that the insulating barrier is disposed between the conductive inner via and the conductive outer via; and wherein the conductive inner via defines an open space of the opening configured to receive a conductor to be inserted therein.

2. The electronic interconnect device of claim 1, wherein a plurality of the conductive outer vias are electrically commoned and grounded.

3. The electronic interconnect device of claim 1, further comprising a ground shield on the substrate, the outer vias being electrically common with the ground shield.

4. The electronic interconnect device of claim 1, wherein the substrate is plated with a ground plating on the first surface and in the plurality of openings, the ground plating defining a ground shield on the first surface and defining the conductive outer vias in the openings, each of the outer vias being electrically commoned by the ground shield.

5. The electronic interconnect device of claim 1, wherein the insulative barriers are coated on the corresponding conductive outer vias and the conductive inner vias are plated on the corresponding insulative barriers.

6. The electronic interconnect device of claim 1, further comprising conductors received in the openings and being electrically connected to the conductive inner vias, the conductors transmitting data signals to the conductive inner vias.

7. The electronic interconnect device of claim 1, wherein the conductive outer vias are electrically connected to a ground layer on the first surface, the insulative barriers being integral with an insulative layer deposited on the ground layer.

8. The electronic interconnect device of claim 1, wherein the insulative barriers are integral with an insulative layer deposited on the second surface, the conductive inner vias being electrically connected to solder pads deposited on the insulative layer, solder balls being applied to corresponding signal pads.

9. The electronic interconnect device of claim 1, wherein the substrate further comprises at least one grounding opening therethrough consisting of a conductive ground via electrically connected to the conductive outer vias, each ground opening being devoid of any insulative barrier and any conductive inner via.

10. An electronic interconnect device comprising:

a substrate having a first surface and a second surface, the substrate having a plurality of openings extending between the first and second surfaces, each opening having a conductive outer via, an insulative barrier deposited on the conductive outer via, and a conductive inner via deposited on the insulative barrier, wherein the conductive outer via, insulative barrier and conductive inner via are concentric within the opening such that the insulative barrier is disposed between the conductive inner via and the conductive outer via, wherein the conductive inner via defines an open space configured to receive a conductor to be inserted therein; and a plurality of conductors received in corresponding conductive inner vias, the conductors being electrically connected to the conductive inner via, the conductors having a first end extending out of the openings and being configured to be electrically connected to a first electronic component.

11. The electronic interconnect device of claim 10, wherein the plurality of conductors are compressive in a longitudinal direction along corresponding opening axes.

12. The electronic interconnect device of claim 10, wherein the plurality of conductors are deflectable in a vertical direction into the openings, the plurality of conductors being deflectable in a horizontal direction to press outward against the inner vias.

13. The electronic interconnect device of claim 10, wherein the plurality of conductors are compressible to shorten and widen the conductors within the openings, the conductors being biased against the conductive inner vias.

14. The electronic interconnect device of claim 10, wherein each conductor comprises a spring and an arrowhead spring extending from the spring and defining the first end, the arrowhead spring having a tip configured to engage the first electronic component, the arrowhead spring being narrower proximate the tip and wider toward the spring.

15. The electronic interconnect device of claim 14, wherein the spring compresses vertically to shorten the conductor, the arrowhead spring deflects outward to widen the conductor and press outward against the conductive inner via.

16. The electronic interconnect device of claim 10 further comprising a cover on the first surface, the cover capturing the conductors in the openings, the conductors being spring biased against toward the cover.

17. The electronic interconnect device of claim 10, wherein the conductors comprise elastomeric columns being internally conductive, the elastomeric column being compressible and pressed outward against the conductive inner vias to define electrical paths between the elastomeric columns and the conductive inner vias.

18. The electronic interconnect device of claim 10, wherein the conductors each have a second end extending out of the openings beyond the second surface, the second ends being configured to be electrically connected to a second electronic component, wherein electrical paths are defined between the first and second electronic components through the conductors and the conductive inner vias.

19. The electronic interconnect device of claim 10, wherein the insulative barriers are integral with an insulative layer deposited on the second surface, the conductive inner vias being electrically connected to signal pads deposited on the insulative layer, solder balls being applied to corresponding signal pads, wherein electrical paths are defined from the first end of the conductor to the conductive inner vias and from the conductive inner vias to the signal pads and solder balls.

20. An electronic interconnect system comprising:

a substrate having a first surface and a second surface, the substrate having a plurality of openings extending between the first and second surfaces, each opening having a conductive outer via, an insulative barrier deposited on the conductive outer via, and a conductive inner via deposited on the insulative barrier, wherein the conductive outer via, insulative barrier and conductive inner via are concentric within the opening such that the insulative barrier is disposed between the conductive inner via and the conductive outer via, wherein the conductive inner via defines an open space configured to receive a conductor to be inserted therein and electrically connected to the conductive inner via; and an electrical connector having a plurality of conductive compliant pins extending therefrom, the compliant pins comprising the conductors that provide electrical connections with the conductive inner vias, when the electrical connector is mated to the substrate at the first surface such that the compliant pins extend into corresponding openings to engage corresponding conductive inner vias.

* * * * *